US006854188B1

(12) United States Patent
Wonderley

(10) Patent No.: US 6,854,188 B1
(45) Date of Patent: Feb. 15, 2005

(54) ONE-PIECE SPRING FOR RAZOR HANDLE

(75) Inventor: Jeffrey W. Wonderley, Verona, VA (US)

(73) Assignee: American Safety Razor Company, Verona, VA (US)

( * ) Notice: Subject to any disclaimer, the term of this patent is extended or adjusted under 35 U.S.C. 154(b) by 37 days.

(21) Appl. No.: 10/279,019

(22) Filed: Oct. 24, 2002

(51) Int. Cl.[7] ..... B26B 21/52
(52) U.S. Cl. ..... 30/532; 30/527
(58) Field of Search ..... 30/47, 50, 526, 30/527, 532

(56) References Cited

U.S. PATENT DOCUMENTS 1,491,596 A * 4/1924 Everett ..... 30/49
3,311,975 A * 4/1967 De Longuyon ..... 30/62
6,122,826 A * 9/2000 Coffin et al. ..... 30/57
6,182,366 B1 * 2/2001 Richard ..... 30/50
6,311,400 B1 * 11/2001 Hawes et al. ..... 30/527
6,421,925 B1 * 7/2002 Wonderley ..... 30/532
6,557,265 B2 * 5/2003 Coffin ..... 30/532
2002/0138992 A1 * 10/2002 Richard ..... 30/527

FOREIGN PATENT DOCUMENTS

GB 2 116 470 * 9/1983

* cited by examiner

*Primary Examiner*—Hwei-Siu Payer
(74) *Attorney, Agent, or Firm*—McDermott Will & Emery LLP

(57) ABSTRACT

A razor handle head is provided having a one-piece spring extending between and molded integrally with a pair of opposed arms that carry connectors to which a razor cartridge movably (e.g., pivotally) mounts. The single-piece spring has a pair of outer spring sections extending from the arms and a center portion with a cam follower which bears against a cam surface on the cartridge to bias the cartridge as it moves relative to the handle head. The one-piece spring also flexes with the arms during assembly of the cartridge to the handle head.

15 Claims, 6 Drawing Sheets

ONE-PIECE SPRING FOR RAZOR HANDLE

FIELD OF THE INVENTION

The present invention relates to shaving razors. The present invention has particular applicability to razor handles configured to permit pivotal rotation of a razor cartridge.

BACKGROUND ART

Many conventional shaving razor handle heads are configured to permit rotation of a razor cartridge about a pivot point. Some arrangements permit free rotation of the razor cartridge through a predetermined range about pins attached to the head and engaging an underside of the razor cartridge. Other types include arcuate bearings formed in the handle head, which mate with hooks on the underside of the razor cartridge. The arcuate bearings determine the range of pivoting motion of the cartridge. Some handle heads spring-load or bias the pivotally mounted razor cartridge toward a neutral position, such as at or near the midpoint of the predetermined range, allowing the cartridge to be displaced away from the neutral position in one direction, and to then move back to the neutral position.

Conventional razor handle heads using springs, such as disposable razor handles, typically employ a pair of discrete beam-type springs which extend towards the middle of the cartridge from the outer portions of the handle head (e.g., from the cartridge pivot points) to contact a camming surface or surfaces of the cartridge. These springs are molded integrally with the handle head. Since they are separate from each other, and often need to attach to two different locations relative to the handle head so they do not interfere with one another in operation, they add to the complexity of the mold and of the molding process. This complexity adds to the cost of the mold, and disadvantageously affects the quality and reliability of the molded parts. For example, one spring may be larger and therefore stronger than the other spring, so the pivoting characteristics of the cartridge in one direction may be different than in the other direction.

There exists a need for a simplified spring for a razor handle, thereby reducing manufacturing costs and improving product quality.

SUMMARY OF THE INVENTION

An advantage of the present invention is a single-piece spring for a razor cartridge which is simpler to produce and provides more reliable performance than multiple piece springs.

According to the present invention, the foregoing and other advantages are achieved in part by a razor cartridge biasing device for a razor handle, comprising a razor handle head having a pair of opposing arms extending from the handle head, distal portions of the arms comprising connectors to which a razor cartridge can be movably connected; a first outer spring section extending from one of the arms towards the other arm and having an inner end; a second outer spring section extending from the other arm toward the first outer spring section and having an inner end; and a spring center portion having a cam follower and a pair of legs, a proximal end of each of the legs being attached to the cam follower at an angle to the cam follower, and a distal end of each of the legs being attached to the inner end of one of the outer spring sections; wherein the cam follower is for contacting a cam surface of the razor cartridge when the razor cartridge is connected to the handle head to bias the razor cartridge with respect to the handle head.

Additional advantages of the present invention will become readily apparent to those skilled in this art from the following detailed description, wherein only the preferred embodiment of the present invention is shown and described, simply by way of illustration of the best mode contemplated for carrying out the present invention. As will be realized, the present invention is capable of other and different embodiments, and its several details are capable of modifications in various obvious respects, all without departing from the invention. Accordingly, the drawings and description are to be regarded as illustrative in nature, and not as restrictive.

BRIEF DESCRIPON OF THE DRAWRNGS

Reference is made to the attached drawings, wherein elements having the same reference numeral designations represent like elements throughout, and wherein.

Figure 3A:
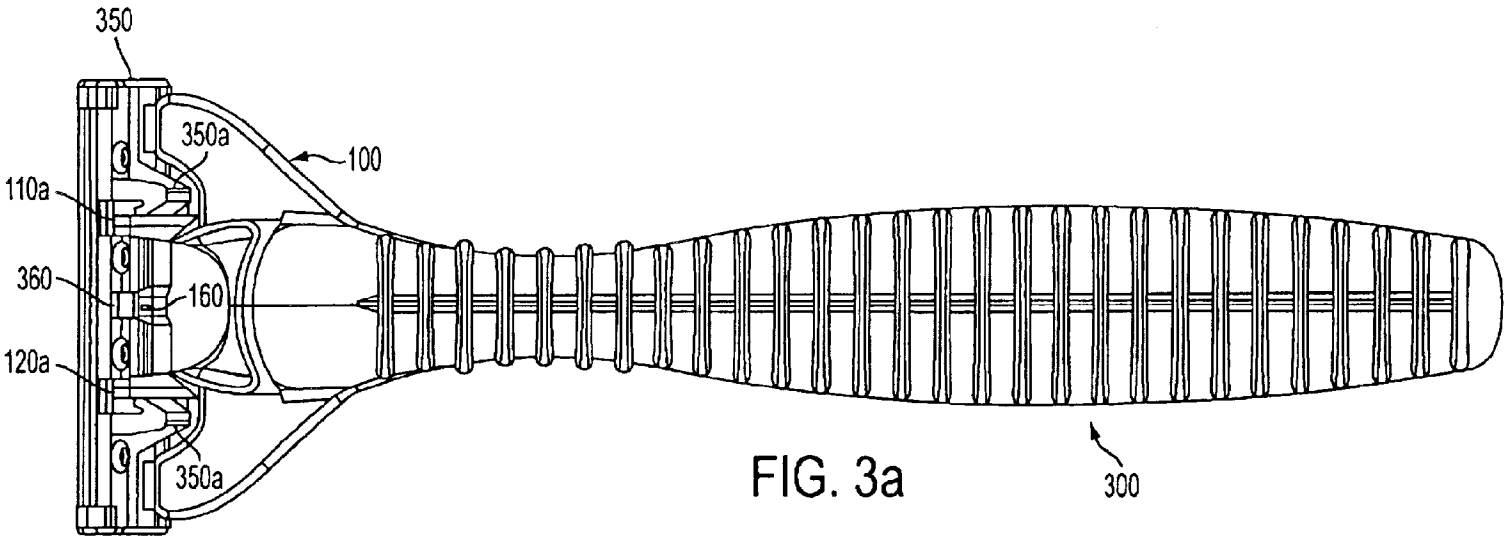
Figure 3B:
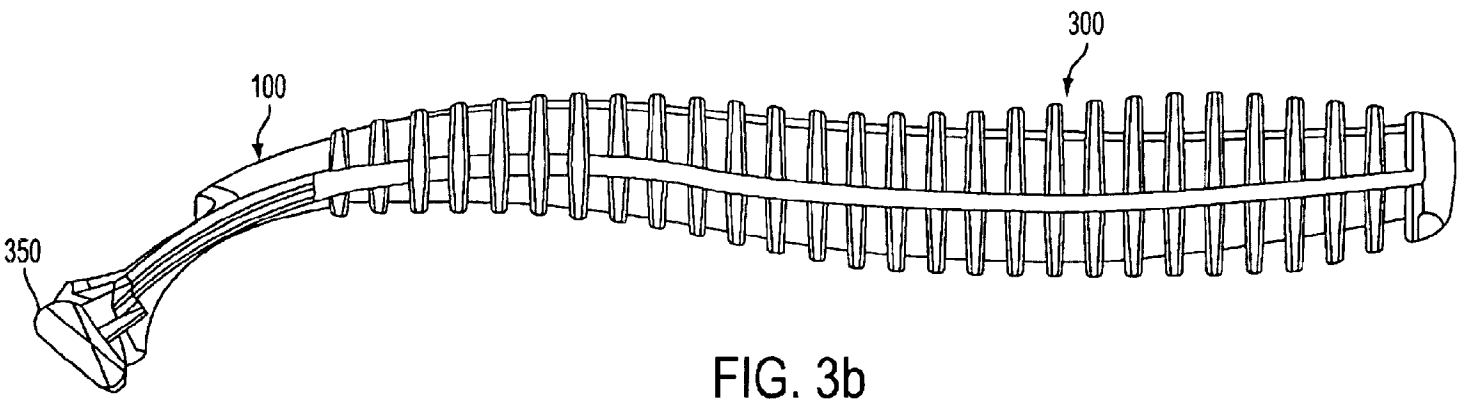
Figure 3C:
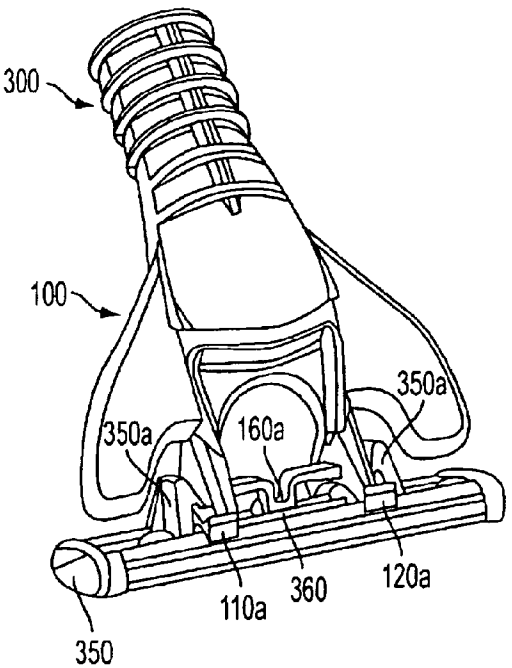

FIGS. 3*a–c* are top, front and perspective views, respectively, of a razor handle and cartridge assembly including the biasing device of an embodiment of the present invention.

Figure 4C:
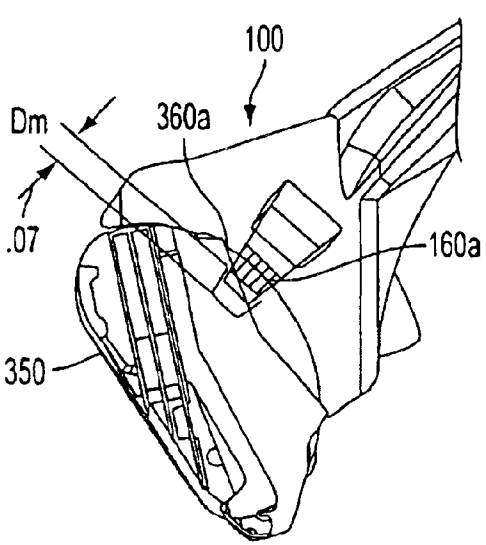
Figure 4B:
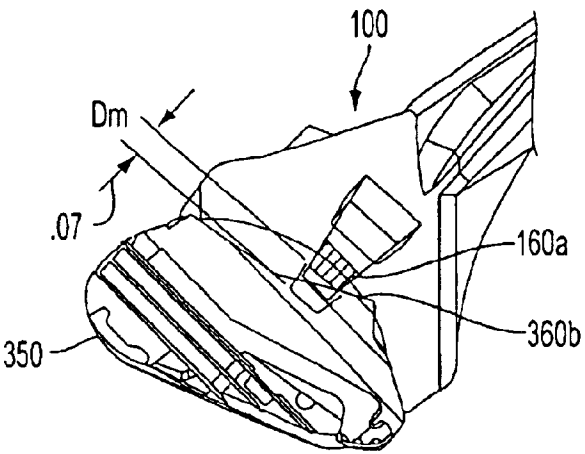
Figure 4A:
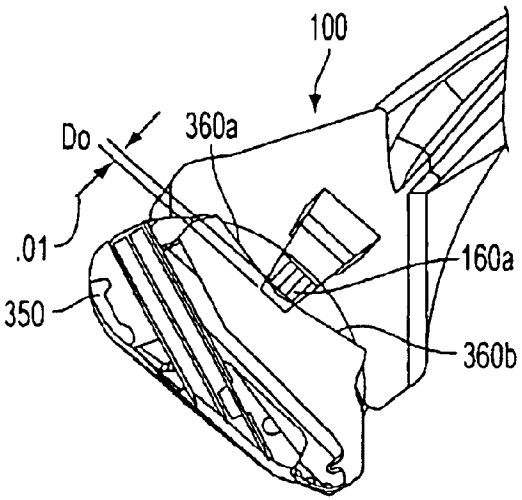

FIGS. 4*a–c* are cross-sectional views of a razor handle and cartridge assembly including the biasing device of an embodiment of the present invention.

Figure 5:
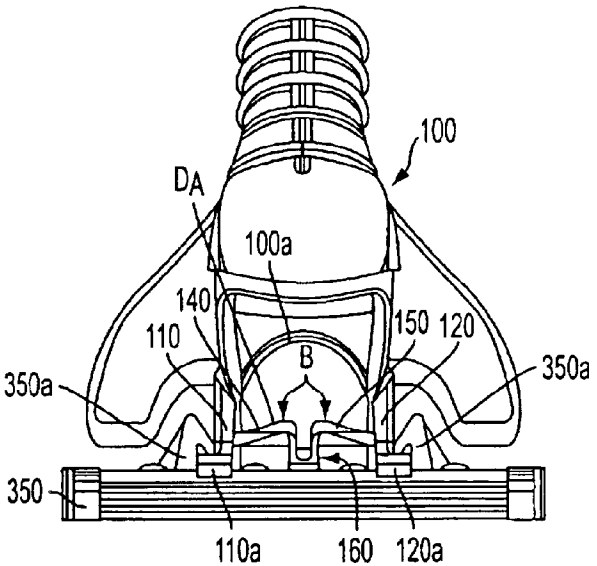

FIG. 5 is a front view of a razor handle and cartridge assembly including the biasing device of an embodiment of the present invention during assembly of the cartridge to the handle.

Figure 6A:
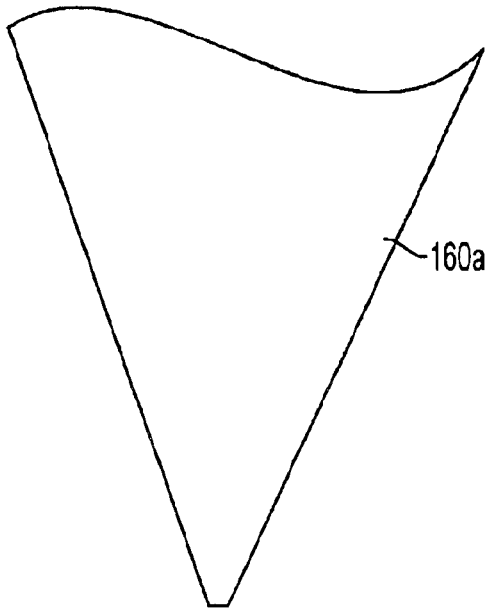
Figure 6B:
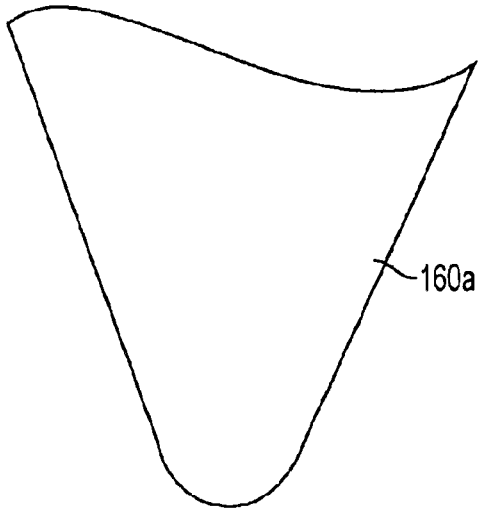

FIGS. 6*a–b* are cross-sectional views of a cam follower of the biasing device according to alternative embodiments of the present invention.

DESCRIPTION OF THE INVENTION

Conventional spring arrangements for biasing pivoting cartridges employ multiple springs, which increases the cost and complexity of the finished device and adversely affects reliability. The present invention addresses and solves these problems stemming from conventional complex springs.

According to the present invention, a razor handle head comprises a one-piece spring extending between and molded integrally with a pair of opposed arms that carry connectors to which a razor cartridge movably (e.g., pivotably) mounts. The inventive single-piece spring has a pair of substantially straight outer spring sections extending from the arms, and a center portion between the outer spring sections having a cam follower which bears against a cam surface on the cartridge to bias the cartridge as it moves relative to the handle head. The one-piece spring of the present invention also flexes with the arms during assembly of the cartridge to the handle head.

Figure 1:
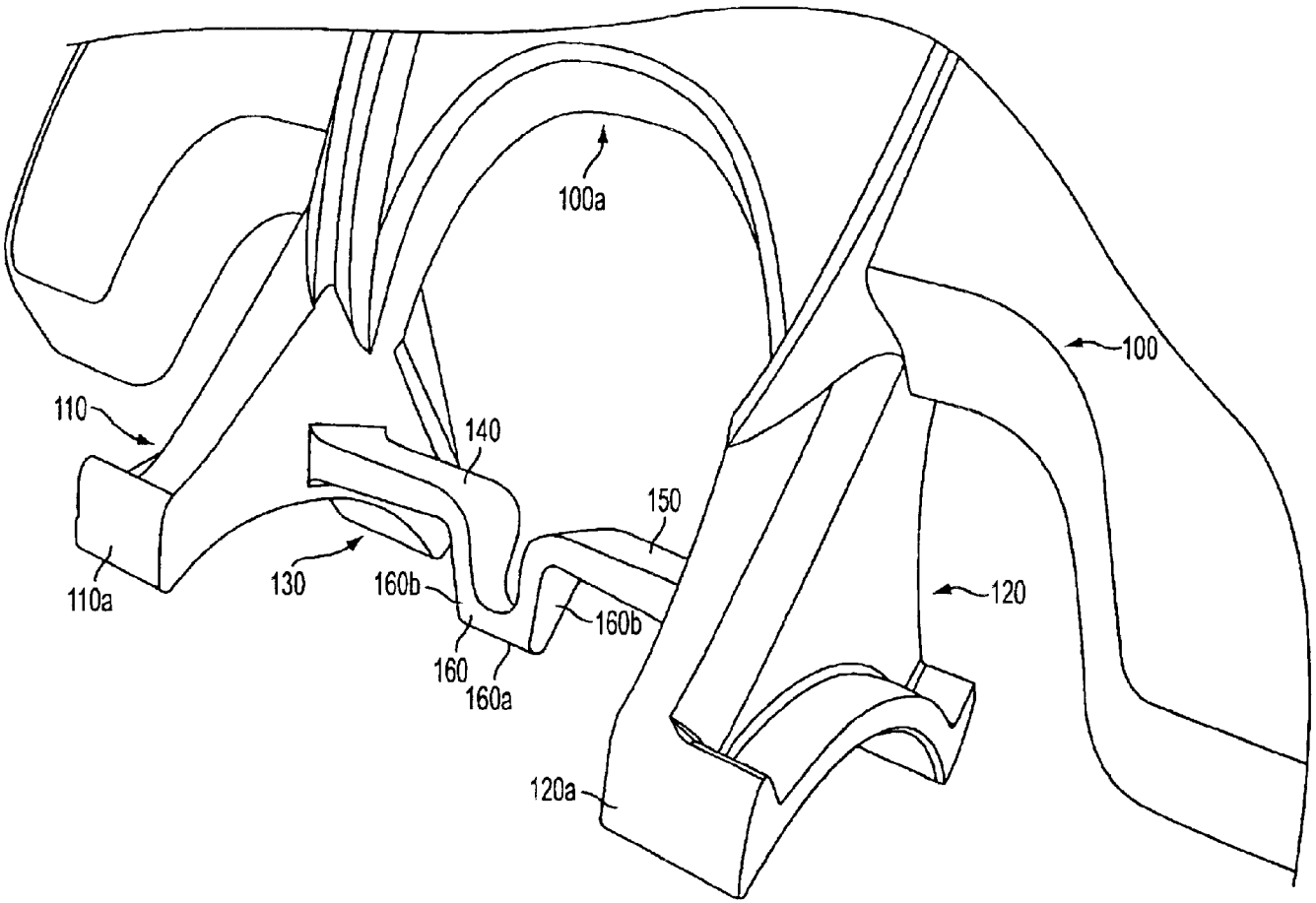
FIG. 1 is a perspective view of a razor cartridge biasing device in accordance with an embodiment of the present invention.
Figure 2:
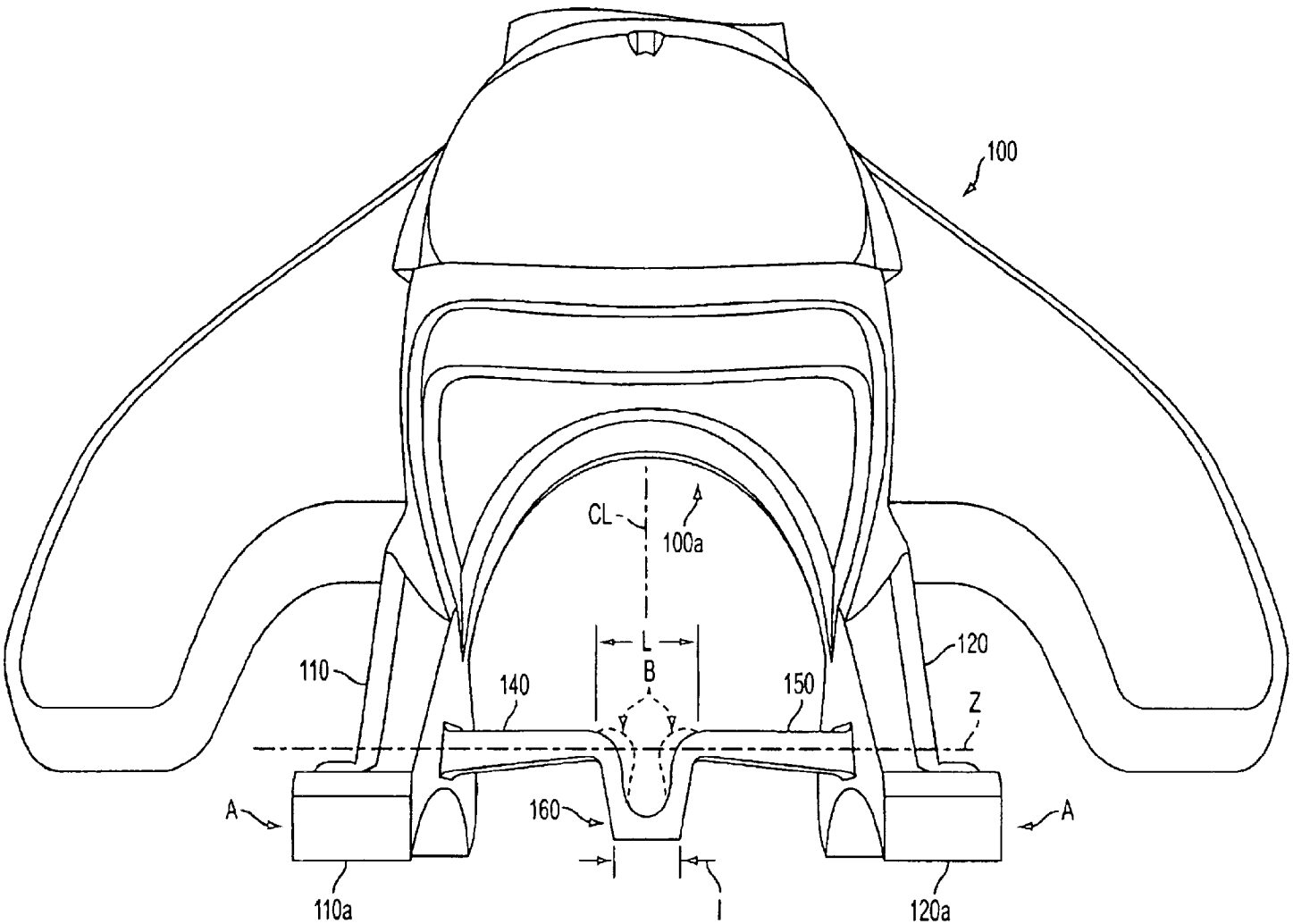
FIG. 2 is a front view of a razor cartridge biasing device according to an embodiment of the present invention.

An embodiment of the present invention will now be described with reference to FIGS. 1 and 2. A razor handle head 100 is provided with two outwardly protruding arms 110, 120. Distal portions of arms 110, 120 bear connectors 11*a*, 120*a*, such as conventional arcuate bearings, to which an underside of a razor cartridge may be pivotally connected and on which a corresponding surface on an underside of the razor cartridge may slide. A single-piece spring 130 extends between arms 110, 120. Spring 130 comprises substantially straight outer spring sections 140, 150 extending inwardly towards each other and toward a center line of razor handle head 100 along a longitudinal axis CL from respective arms 110, 120. Outer spring sections 140, 150 extend towards each other along a common axis Z; in other words, outer spring sections 140, 150 originate at the same location on each of arms 110, 120.

Spring 130 further comprises a spring center portion 160 having a cam follower 160*a* and a pair of legs 160*b*. One end of each leg 160*b* is attached to cam follower 160*a* at an angle to cam follower 160*a* such that spring center portion 160 is substantially U-shaped. The other end of each leg 160*b* is attached to the inner end of one of outer spring sections 140, 150, such that cam follower 160*a* is substantially parallel to outer spring sections 140, 150. Cam follower 160*a* has a length l, and legs 160*b* attach to cam follower 160*a* such that a distance L between the distal ends of legs 160*b* is greater than cam follower length l.

FIGS. 3*a–c* and 4*a–c* depict a razor handle 300 having handle head 100 attached to a razor cartridge 350 useable with the inventive spring 130. Arcuate bearings of connectors 110*a*, 120*a* mate with hooks 350*a* of cartridge 350 to retain cartridge 350 on handle 300. Cam follower 160*a* of spring 130 is for contacting a cam surface 360 of razor cartridge 350 (best seen in FIG. 4*a*) when razor cartridge 350 is connected to handle head 100, to bias razor cartridge 350 with respect to handle head 100. Cam surface 360 is a V-shape, with two opposing cam portions 360*a*, 360*b* sloping from a central point. Cam follower 160*a* has a wedge shape cross-section for following V-shaped cam surface 360, as shown in FIGS. 4*a–c*.

FIG. 4*a* depicts a neutral position of razor cartridge 350 relative to razor handle 300 and cam follower 160*a*, wherein cam follower 160*a* is positioned in the center of the "V" of cam surface 360 between opposing cam portions 360*a*, 360*b*. Cam follower 160 has a deflection $D_0$ about 0.01" or more when cartridge 350 is in the neutral position to provide a preload to bias cartridge 350 at the neutral position. FIG. 4*b* depicts an extreme forward pivoting position of cartridge 350 wherein cam follower 160*a* is deflected to a maximum predetermined deflection $D_m$ of about 0.07" as cartridge 350 pivots and it follows cam portion 360*b*. FIG. 4*c* depicts an extreme rearward pivoting position of cartridge 350 wherein cam follower 160*a* is deflected to the maximum predetermined deflection $D_m$ of about 0.07" as cartridge 350 pivots and it follows cam portion 360*a*. The deflection of cam follower 160*a*, and the resulting deflection of outer spring sections 140, 150, causes a biasing force that urges cartridge 350 back towards the neutral position.

FIG. 6*a* depicts a cross-section of cam follower 160*a* according to one embodiment of the present invention, wherein wedge-shaped cam follower 160*a* has a V-shape with a narrow, substantially pointed tip. FIG. 6*b* depicts a cross-section of cam follower 160*a* according to an alternative embodiment of the present invention, wherein cam follower 160*a* has a flatter, rounded tip. The embodiment of FIG. 6*b* provides a wider contact point with cam surface 360 of cartridge 350, advantageously resulting in more torque to rotate cartridge 350 back to the neutral position in response to the forces exerted by spring 1.30.

Handle head 100 flexes to allow the distal portions of arms 110, 120 to be displaced towards each other to allow connection of cartridge 350 to handle head 100. As shown in FIGS. 2 and 5, the distal portions of arms 110, 120 displace towards each other about 0.05" in the direction A to allow hooks 350*a* of cartridge 350 to snap in place on arcuate bearings 110*a*, 120*a*. Outer spring sections 140, 150 and spring center portion 160 have a deflection $D_A$ at inner corners B when arms 110, 120 flex towards each other. Handle head 100 has a curved opening 100*a* between arms 110, 120 to allow the distal portions of arms 110, 120 to be displaced towards each other. However, arms 110, 120 are rigid in use, when cantilevered outer spring sections 140, 150 and spring center portion 160 impart the biasing force to cartridge cam surface 360 upon the pivoting movement of cartridge 350.

The single-piece spring of the present invention is simpler to mold than conventional multiple spring designs, where the springs often attach at different relative locations on each arm. Since the tooling needed to make the inventive spring design is simpler, it costs less than tooling used to make conventional springs, and the quality of the molded parts typically is higher. For example, the inventive spring design will result in less molding flash and cleaner parts coming out of the mold. Moreover, the one-piece spring of the present invention stabilizes the handle head arms during the molding process by supporting the arms as the molded part cools and shrinks, resulting in improved dimensional quality.

Reliability and operation of the finished device is also improved using the spring of the present invention. For example, the molding of conventional separate springs can result in one spring being larger and therefore stronger than the other, so the pivoting force in one direction is different than in the other direction. Furthermore, two-piece springs can slip off the cartridge cam surface while the razor is in use, resulting in degraded performance. However, the inventive one-piece spring cannot slip off the cartridge cam surface. The razor handle with the inventive one-piece spring is also easier to handle during the manufacturing process. Conventional separate springs have a gap between them. Therefore, when conventional handles are placed in a bin with many other identical handles, they tend to become tangled with each other. The one-piece spring of the present invention does not have parts with small gaps between them, so they do not become tangled.

The present invention can be practiced by employing conventional materials, methodology and equipment. Accordingly, the details of such materials, equipment and methodology are not set forth herein in detail. In the previous descriptions, numerous specific details are set forth, such as specific materials, structures, chemicals, processes, etc., in order to provide a thorough understanding of the present invention. However, it should be recognized that the present invention can be practiced without resorting to the details specifically set forth. In other instances, well known processing structures have not been described in detail, in order not to unnecessarily obscure the present invention.

Only the preferred embodiment of the present invention and but a few examples of its versatility are shown and described in the present disclosure. It is to be understood that the present invention is capable of use in various other combinations and environments and is capable of changes or modifications within the scope of the inventive concept as expressed herein.

What is claimed is:

1. A razor cartridge biasing device for a razor handle, comprising:

a razor handle head having a pair of opposing arms extending from the handle head, distal portions of the arms comprising connectors to which a razor cartridge can be movably connected;

a first outer spring section extending from one of the arms towards the other, arm and having an inner end;

a second outer spring section extending from the other arm toward the first outer spring section and having an inner end; and a spring center portion having a cam follower and a pair of legs, a proximal end of each of the legs being attached to the cam follower at an angle to the cam follower, and a distal end of each of the legs being attached to the inner end of a respective one of the outer spring sections;

wherein the spring center portion is substantially U-shaped; and wherein the cam follower is for contacting a cam surface of the razor cartridge when the razor cartridge is connected to the handle head to bias the razor cartridge with respect to the handle head.

2. The biasing device of claim 1, wherein the cartridge is pivotably connectible to the handle head at the connectors, and wherein the outer spring sections and the spring center portion are for imparting a biasing force, relative to a center of pivot action of the razor cartridge, to the cartridge cam surface upon a pivoting movement of the cartridge from a neutral position.

3. The biasing device of claim 2, wherein the handle head is for flexing to allow the distal portions of the arms to be displaced towards each other to allow connection of the cartridge to the handle head, and the outer spring sections and the spring center portion are deformable when the arms flex towards each other.

4. The biasing device of claim 3, wherein the distal portions of the arms displace towards each other about 0.05" to allow connection of the cartridge to the handle head.

5. The biasing device of claim 3, wherein the handle head arms are rigid when the outer spring sections and the spring center portion impart the biasing force to the cartridge cam surface upon the pivoting movement of the cartridge.

6. The biasing device of claim 2, wherein the cam follower deflects 0.07" or less in response to the pivoting movement of the cartridge from the neutral position.

7. The biasing device of claim 2, wherein the cam follower is deflected at least about 0.01" when the cartridge is in the neutral position.

8. The biasing device of claim 2, wherein the connectors comprise arcuate bearings for engaging mating surfaces of the razor cartridge for pivotally retaining the cartridge on the handle head.

9. The biasing device of claim 2, wherein the cam follower has a wedge shape cross-section with a substantially pointed tip for following a V-shaped portion of the cartridge cam surface.

10. The biasing device of claim 2, wherein the cam follower has a wedge shape cross-section with a rounded tip for following a V-shaped portion of the cartridge cam surface.

11. The biasing device of claim 1, wherein the first and second outer spring sections are substantially straight.

12. The biasing device of claim 1, wherein the cam follower has a length, and the legs attach to the cam follower such that a distance between the distal ends of the legs is greater than the cam follower length.

13. The biasing device of claim 1, wherein the cam follower is substantially parallel to the first and second outer spring sections.

14. A razor cartridge biasing device for a razor handle, comprising:

a razor handle head having a pair of opposing arms extending from the handle head, distal portions of the arms comprising connectors to which a razor cartridge can be movably connected;

a first outer spring section extending from one of the arms towards the other arm and having an inner end;

a second outer spring section extending from the other arm toward the first outer spring section and having an inner end; and a spring center portion having a cam follower and a pair of legs, a proximal end of each of the legs being attached to the cam follower at an angle to the cam follower, and a distal end of each of the legs being attached to the inner end of a respective one of the outer spring sections;

wherein the cam follower is for contacting a cam surface of the razor cartridge when the razor cartridge is connected to the handle head to bias the razor cartridge with respect to the handle head; and wherein the handle head has a curved opening between the arms to allow the distal portions of the arms to be displaced towards each other.

15. A razor cartridge biasing device for a razor handle, comprising:

a razor handle head having a pair of opposing arms extending from the handle head, distal portions of the arms comprising connectors to which a razor cartridge can be movably connected;

a first outer spring section extending from one of the arms towards the other arm and having an inner end;

a second outer spring section extending from the other arm toward the first outer spring section and having an inner end; and a spring center portion having a cam follower and a pair of legs, a proximal end of each of the legs being attached to the cam follower at an angle to the cam follower, and a distal end of each of the legs being attached to the inner end of a respective one of the outer spring sections;

wherein the cam follower is for contacting a cam surface of the razor cartridge when the razor cartridge is connected to the handle head to bias the razor cartridge with respect to the handle head; and wherein the first and second outer spring sections extend towards each other from the handle head arms along a common axis.

* * * * *